US009845224B2

(12) United States Patent
Rasanen et al.

(10) Patent No.: US 9,845,224 B2
(45) Date of Patent: Dec. 19, 2017

(54) DOOR ARRANGEMENT OF AN ELEVATOR

(71) Applicants: Matti Rasanen, Hyvinkaa (FI); Markku Haapaniemi, Helsinki (FI); Markku Haivala, Hyvinkaa (FI)

(72) Inventors: Matti Rasanen, Hyvinkaa (FI); Markku Haapaniemi, Helsinki (FI); Markku Haivala, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 32 days.

(21) Appl. No.: 15/045,625

(22) Filed: Feb. 17, 2016

(65) Prior Publication Data

US 2016/0159616 A1 Jun. 9, 2016

(30) Foreign Application Priority Data

Oct. 2, 2013 (FI) ..... 20135982

(51) Int. Cl.
*B66B 13/12* (2006.01)
*B66B 13/30* (2006.01)
(Continued)

(52) U.S. Cl.
CPC ..... *B66B 13/12* (2013.01); *B66B 13/08* (2013.01); *B66B 13/30* (2013.01); *B66B 13/303* (2013.01); *E05D 15/0652* (2013.01)

(58) Field of Classification Search
CPC ..... B66B 13/08; B66B 13/12; B66B 13/30; B66B 13/303; E05D 15/0652
See application file for complete search history.

(56) References Cited

U.S. PATENT DOCUMENTS 1,738,686 A * 12/1929 Brady ..... B66B 13/12 187/319
1,889,112 A * 11/1932 Shoemaker ..... E05D 15/0613 105/155
(Continued)

FOREIGN PATENT DOCUMENTS

DE 2735614 A1 2/1979
EP 0242545 A1 10/1987
(Continued)

OTHER PUBLICATIONS

Finnish Search Report for 20135982, dated Aug. 1, 2014.
(Continued)

*Primary Examiner* — Minh Truong
(74) *Attorney, Agent, or Firm* — Harness, Dickey & Pierce, PLC

(57) ABSTRACT

The object of the invention is a door arrangement of an elevator, which elevator comprises at least an elevator car, an elevator car door with door panels and a suspension beam for the door panels, as well as a door motor and door coupler structure, and also landing doors, with door panels, of the floor levels and a suspension beam for the door panels, as well as a synchronization means and rollers for the door coupler. The suspension beam of the door panels of the elevator car is disposed below the motor of the door operator and the door coupler structure, and that the suspension beam of the door panels of a landing door is disposed below the synchronization means of the door panels and the rollers of the door coupler.

16 Claims, 4 Drawing Sheets

Figure 1:
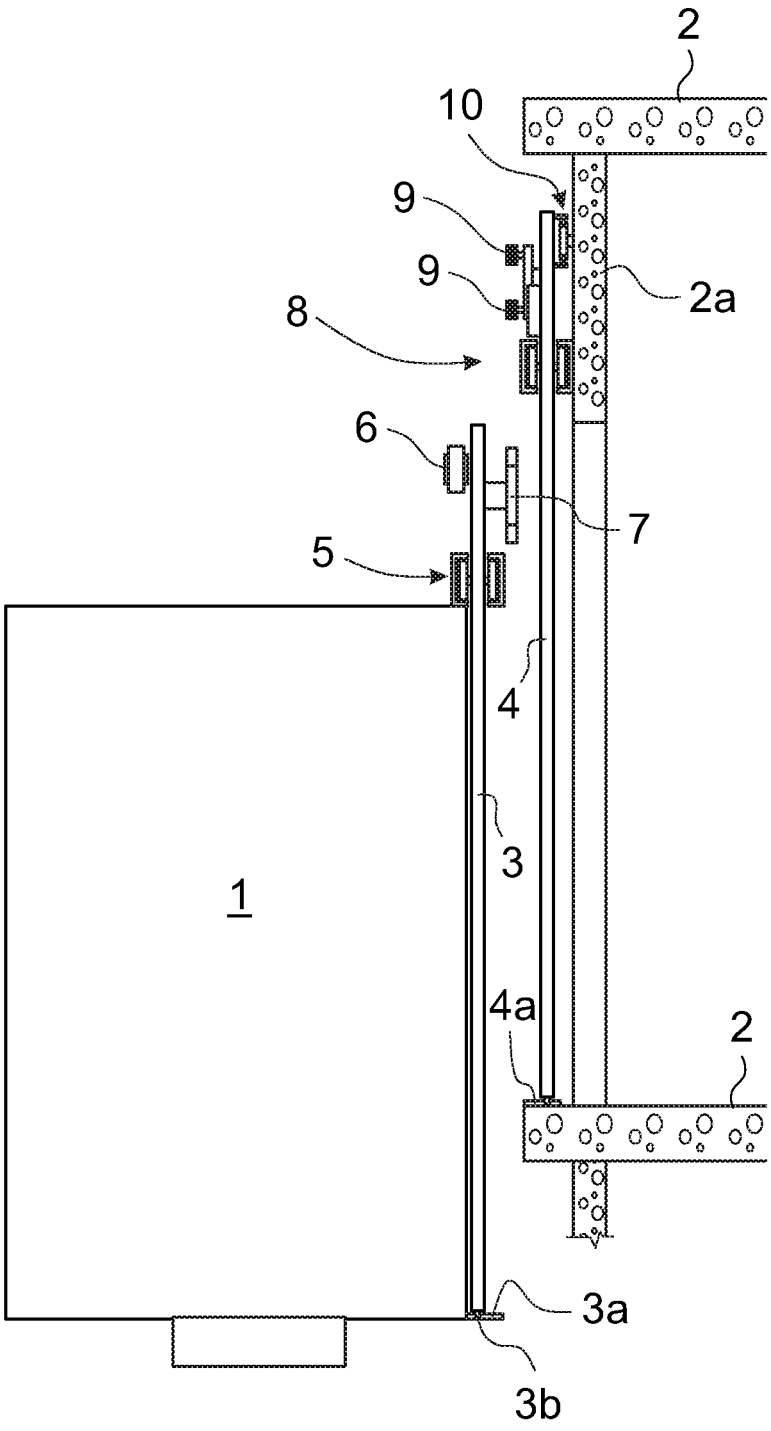

(51) Int. Cl.
*B66B 13/08* (2006.01)
*E05D 15/06* (2006.01)

(56) References Cited

U.S. PATENT DOCUMENTS

| | | | | | |
|---|---|---|---|---|---|
| 2,235,381 | A | * | 3/1941 | McCormick | B66B 13/12 187/301 |
| 2,481,124 | A | * | 9/1949 | Kruger | B66B 13/12 187/301 |
| 2,600,670 | A | * | 6/1952 | Minium | E05D 15/063 16/95 R |
| 4,004,655 | A | | 1/1977 | Kraft et al. | |
| 4,043,430 | A | | 8/1977 | Kraft et al. | |
| H1362 | H | * | 10/1994 | Herrmann | B66B 13/08 187/324 |
| 5,542,149 | A | * | 8/1996 | Yu | A47H 15/02 16/87.4 R |
| 5,606,826 | A | * | 3/1997 | Calhoun | B66B 13/08 49/138 |
| 5,668,355 | A | * | 9/1997 | Jaminet | B66B 13/08 187/315 |
| 5,896,952 | A | | 4/1999 | Dohring et al. | |
| 2012/0048657 | A1 | | 3/2012 | Christen | |
| 2014/0332323 | A1 | | 11/2014 | Christen | |

FOREIGN PATENT DOCUMENTS

| | | | |
|---|---|---|---|
| EP | 2426076 | A1 | 3/2012 |
| JP | S54165967 | U | 11/1979 |
| JP | 2005112512 | A | 4/2005 |
| KR | 101039633 | B1 | 6/2011 |
| WO | WO-2005047162 | A1 | 5/2005 |
| WO | WO-2009050327 | A1 | 4/2009 |

OTHER PUBLICATIONS

International Search Report PCT/ISA/210 for International Application No. PCT/FI2014/050753 dated Jan. 21, 2015.

Written Opinion of the International Searching Authority PCT/ISA/237 for International Application No. PCT/FI2014/050753 dated Jan. 21, 2015.

* cited by examiner

DOOR ARRANGEMENT OF AN ELEVATOR

This application is a continuation of PCT International Application No. PCT/FI2014/050753 which has an International filing date of Oct. 2, 2014, and which claims priority to Finnish patent application number 20135982 filed Oct. 2, 2013, the entire contents of both of which are incorporated herein by reference.

The present invention relates to a door arrangement of an elevator as defined in the preamble of claim 1.

One problem, among others, in the prior-art sliding doors of an elevator has been the thickness of the door operator and of its support structures, as well as the thickness of the door panels, in the depth direction of the elevator car. In these prior-art solutions the door panels of the sliding doors of the elevator car are usually suspended on a suspension beam above the door in the top part of the elevator car by means of support rollers and a roller race in connection with the suspension beam. One typical example solution of this type of suspension is presented in European patent publication EP 0242545 B1, in which the roller races of the support rollers of the door panels are fixed by means of support elements to the suspension beam structure above the door. The roller races are placed one above the other in a vertical plane at a relatively large vertical distance from each other. The solution according to the patent publication enables a relatively thin door suspension solution, and this makes it well suited for use in, inter alia, elevator modernization projects when changing at the same time old door solutions for newer solutions. Many thicker door solutions known in the art are not well suited for such elevator modernization projects. The door structure according to the EP publication, however, is fairly expensive to manufacture and install because it comprises numerous different components, and these have to be installed in the installation phase to produce a single functional assembly. The installation of this type of door structure is therefore a time-consuming, error-prone and an expensive procedure. A general drawback for other elevator door solutions according to prior art is the large number of different components, awkward installation, heavy door panel structures and door operator structures, and a fairly high cost level.

The aim of this invention is to eliminate the aforementioned drawbacks and to achieve a novel type of door arrangement of an elevator. The arrangement according to the invention is characterized by what is disclosed in the characterization part of claim 1. Other embodiments of the invention are characterized by what is disclosed in the other claims. Preferably the target door arrangement can be easily and quickly installed. Preferably the target door arrangement is also lightweight and does not comprise many different parts. Another aim is relatively low manufacturing costs and installation costs. An ancillary aim is to achieve advantageous space utilization and suspension of the door panels that is as central as possible. Yet another aim is to achieve a modular door arrangement in which the same door panels and support structures can be used both in the elevator car and in the doors of a landing, and even in the other doors of the building.

The invention can be implemented as an elevator door arrangement, wherein at least the suspension beam of the door panels of the elevator car are disposed below the motor of the door operator and the door coupler structure or at least the suspension beam of the door panels of a landing door of the elevator is disposed below the synchronization means of the door panels and the rollers of the door coupler.

A suspension beam of the door panels of a solution that implements the invention is preferably an essentially shallow structure.

A suspension beam of the elevator car door panels of a solution implementing the invention and the suspension beams of the door panels of landing doors of the solution implementing the invention are essentially similar and at least in cross-section of essentially the same size.

Preferably the support rollers of a door panel of a solution implementing the invention are disposed symmetrically with respect to the vertical line of the door panel on both sides of the door panel in such a way that the weight of the door panel is distributed essentially centrally onto the support rollers on both sides of the door panel.

Preferably the door panels in a solution implementing the invention extend from below their suspension beams through their suspension beams to above their suspension beams. The door panels can be implemented otherwise also within the scope of the invention e.g. in such a way that separate suspension parts connect to the door panels, in which case the door panels extend from below upwards to just below or to inside the suspension beam and are suspended from the support parts, which comprise support rollers resting on the suspension beam.

In a door arrangement implementing the invention preferably the suspension beam of the door panels of the elevator car is below the motor of the door operator and the door coupler structure and the suspension beam of the door panels of a landing door of the elevator is below the synchronization means of the door panels and the rollers of the door coupler.

A preferred solution according to the invention is one in which the suspension beam of the car door is immediately on the top edge of the door opening of the elevator car and the suspension beam of a landing door is immediately on the top edge of the door opening of the landing. In this case when a car door and landing door are open, the suspension beams in practice cover the gap looking into the elevator hoistway at the top edge of the door openings, except for a gap of approx. the size of the sill gap.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage, among others, that can be achieved by means of the invention is that by means of it a door arrangement that is advantageous in terms of its cost level is achieved, which door arrangement is also easy and quick to install into position and, owing to this ease, also possible installation errors decrease. Another advantage is the lightweight structure and door panels that can easily be disposed centrally, in which case there is no need to take the centering of the moving masses into account in the manufacturing of a door. An advantage of a lightweight structure generally is that it also enables lighter counterweights/compensating weights, lower energy consumption when the elevator car moves and in fast elevators, among others, easier balancing of the car. Likewise fewer raw materials are needed. One advantage is also the small number of parts needed in the door structure, which in turn makes installation easier and lowers the cost level. A significant advantage is the possibility of making the parts as modules, in which case the modularity achieved enables, inter alia, the use of the same door panels and support structures both in the elevator car and in the doors of a landing, and even in the other doors of the building. Yet another advantage is a saving in space, especially in the vertical direction, because the lack of a, generally, high top track enables an essentially shallow structure belonging to the door arrangement in the top part of the elevator car and top part of the floor level. Yet a further advantage is that installation of the doors is possible from the landing. This raises the safety level e.g. in so-called "jump lifts", in which a door corresponding to a landing door can immediately be installed into position with the arrangement according to the invention once the door opening is revealed after the casting. This is possible because the suspension system is simple. In this case, construction-time door panels can be used as temporary landing doors in so-called "jump lifts", in which case construction-time impurities, including inter alia dust, small stones, damp, et cetera, in the elevator hoistway do not damage the final door panels and their support rollers. Yet another advantage is the space saving in the depth direction of the elevator car and the visual obstruction created by the suspension beam of the door panels for covering the gap between the elevator car and the front wall of the elevator hoistway. Another advantage is also the shallow structure of the suspension solution for the doors, which enables low-headroom top clearances of the elevator hoistway.

Figure 2:
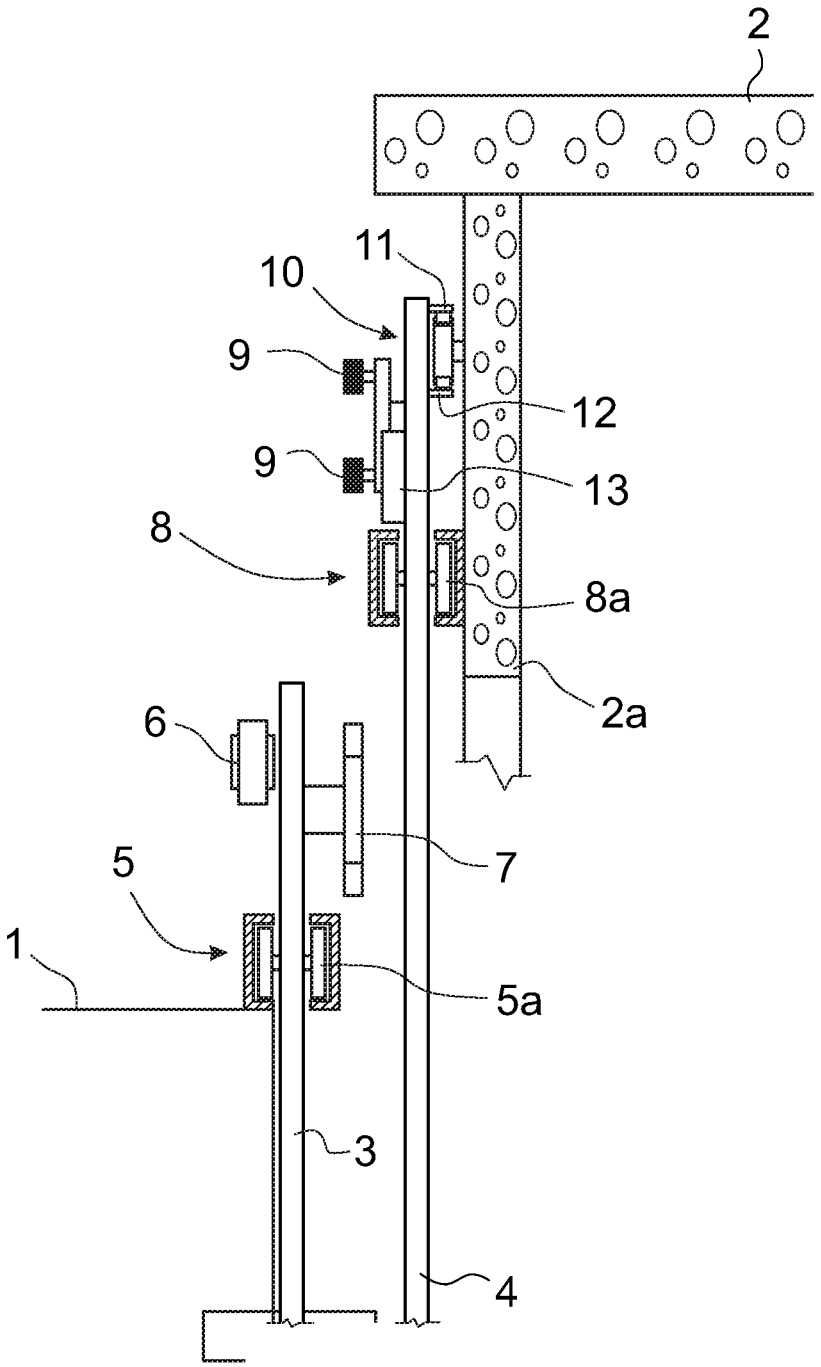
Figure 3:
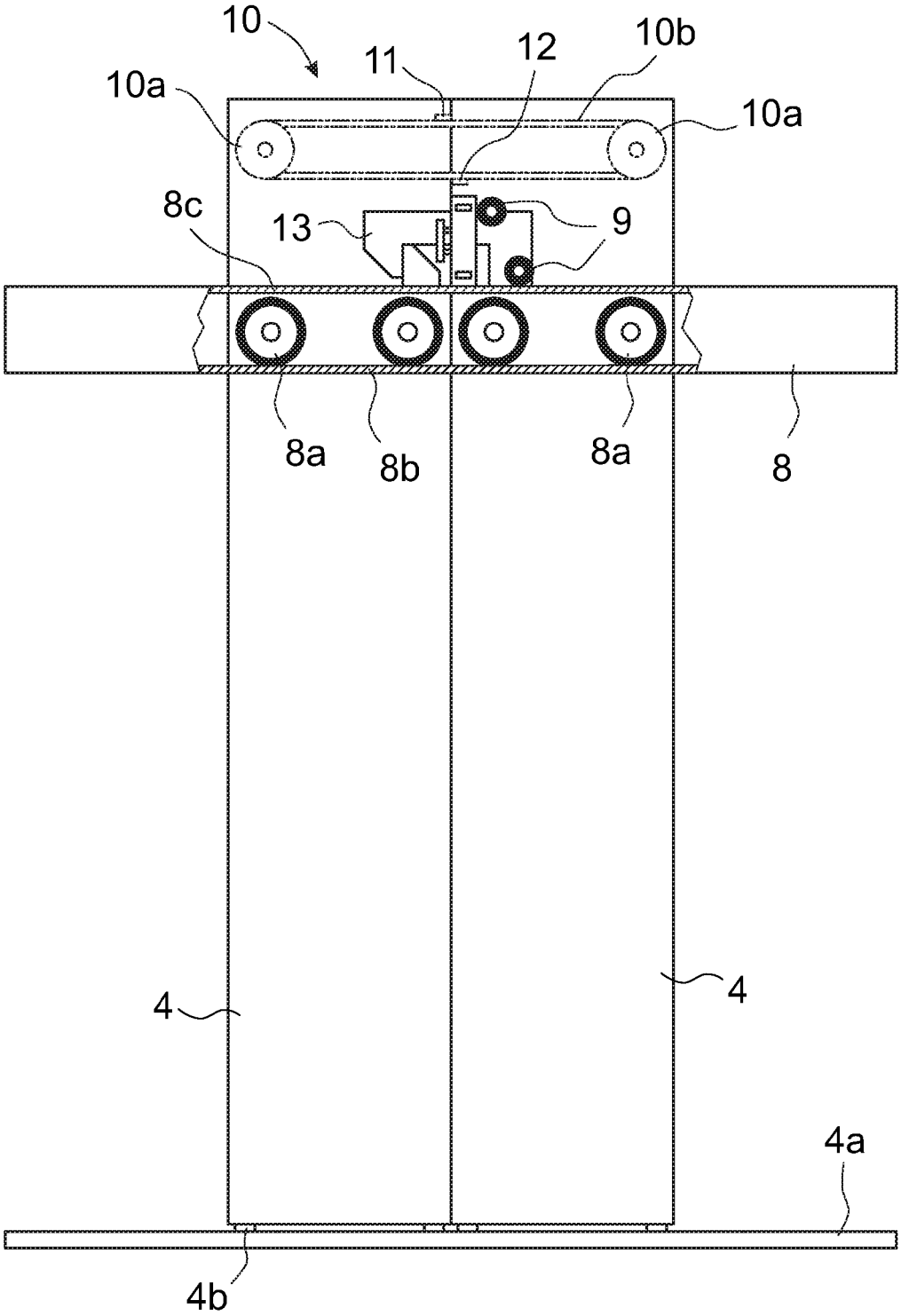
Figure 4:
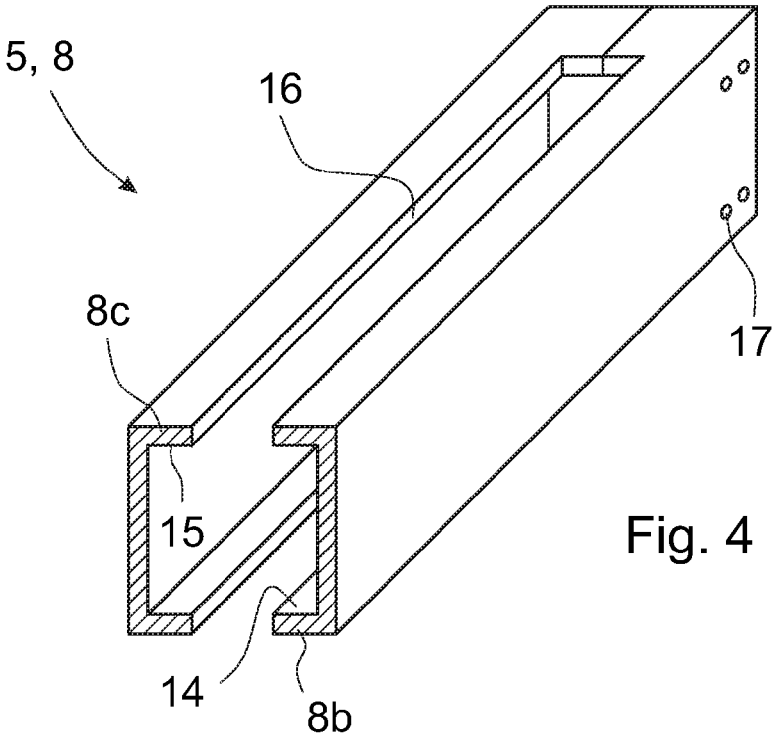
Figure 5:
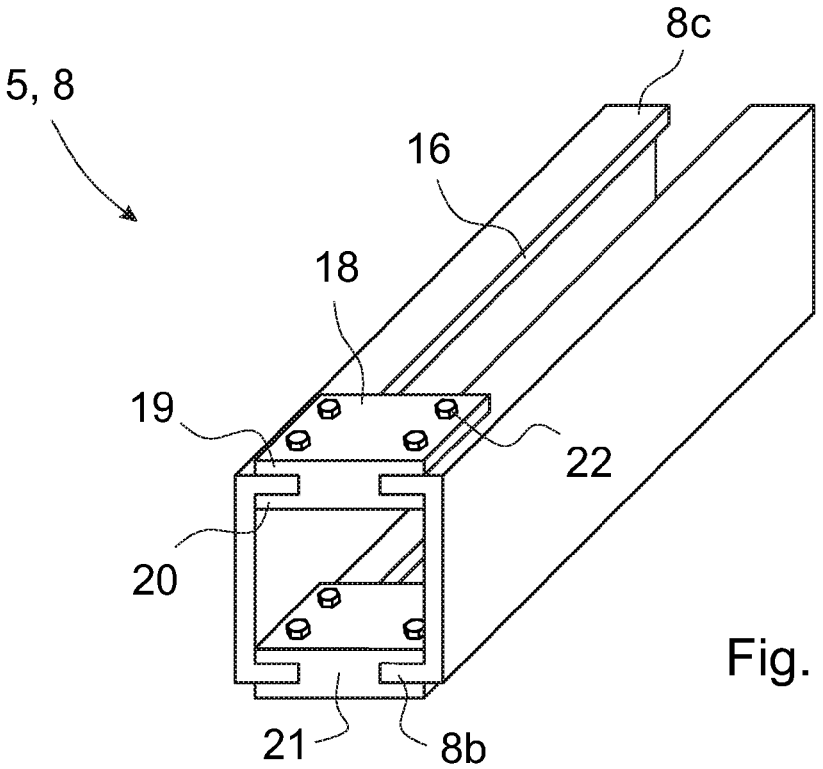

In the following, the invention will be described in more detail by the aid of one example of its embodiments with reference to the simplified and diagrammatic drawings attached, wherein FIG. 1 presents a simplified and diagrammatic side view of one door arrangement, according to the invention, of an elevator at the point of one floor level, FIG. 2 presents a simplified and diagrammatic magnified side view of the door arrangement, according to FIG. 1, of an elevator at the top part of the elevator car and floor level, FIG. 3 presents a simplified and diagrammatic view of a partially sectioned door arrangement, according to FIG. 1, of a landing door of an elevator as seen from the direction of the elevator car, FIG. 4 presents a simplified and diagrammatic oblique top view of one sectioned suspension beam of the door panels belonging to a door arrangement according to the invention, and FIG. 5 presents a simplified and diagrammatic oblique top view of one truncated fixing solution for the parts of the suspension beam of the door panels belonging to a door arrangement according to the invention, at one end of the beam.

FIGS. 1 and 2 present a simplified and diagrammatic side view of one door arrangement, according to the invention, of an elevator at the point of one floor level 2. In the situation according to FIGS. 1 and 2, the elevator car 1 is to some extent below the lower floor level 2 visible in FIG. 1, so that the door structures that are in the top part of the elevator car 1 and of the floor level 2 would be seen more clearly in the figures. FIG. 1 presents a door arrangement from the height of one complete floor level 2 and in FIG. 2 the same structure is presented, magnified and only the top part of it.

The elevator car 1 comprises a car door arrangement, which comprises e.g. two door panels 3, opening from the center and forming a sliding door, which door panels are suspended by means of support rollers 5*a* on a suspension beam 5 fixed to the top part of the elevator car 1. The door operator of the elevator car 1 also comprises a door drive motor 6 above the suspension beam 5, which motor in this case is an essentially flat, permanently-magnetized, gearless electric motor fixed to the roof structures of the elevator car, in which case its space requirement, particularly in the depth direction of the elevator car 1, is the minimum possible. Alternatively, the motor can also be a direct-current motor, if e.g. batteries are used in the electrification of the car. The advantage of a direct-current motor is the high torque. For the sake of clarity, the roof structures of the elevator car 1 are not presented in FIG. 1. The motor could just as well, however, also be some other type of drive motor. The door structure of the elevator car 1 also comprises a door coupler structure 7 that is above the suspension beam 5 and oriented to the side of the landing door, which door coupler structure opens and closes the landing door in conjunction with the opening and closing of the door of the elevator car 1. In addition, in the sill 3*a* of the door of the elevator car 1 is a guide groove, in which the guides 3*b* on the bottom edge of a door panel 3 are adapted to travel. One alternative is also that, since a fire-resistance rating is not needed, the door panel can be made to be so thin that the bottom edge of the door simultaneously functions as a bottom guide. In this case separate guides are not needed.

Correspondingly, the landing door of the elevator has two door panels 4, opening from the center and forming a sliding door, which door panels are suspended by means of support rollers 8*a* on a suspension beam 8 fixed to the top part of the floor level 2, e.g. to a wall element 2*a* at the roof boundary of the floor level 2. The structures of a landing door additionally comprise at least a lock device 13 above the suspension beam 8 and also door coupler rollers 9 above the suspension beam 8 that are connected to the door coupler structure 7 on the elevator car 1 and point from the landing door towards the elevator car 1. In order for the center-opening sliding door structure to function in the manner desired and both door panels 4 to open and close at the same speed and at the same time, the door arrangement must have a synchronization means 10 for the door panels, the structure of which means is described in more detail in connection with the description of FIG. 3. In addition, in the sill 4*a* of the landing door is a guide groove, in which the guides 4*b*, which correspond to the guides 3*b*, on the bottom edge of a door panel 4 are adapted to travel.

The height positions of the suspension beams 5 and 8 in essentially in the horizontal direction are adapted to each other in such a way that when the elevator car 1 is in its correct position at a floor level 2 the suspension beams 5 and 8 are at essentially the same height as each other. In this case the suspension beams 5 and 8 effectively close the gap between the door of the elevator car 1 and the landing door, so that when the doors are open there is no view from the elevator car 1 into the elevator hoistway via the aforementioned gap. In addition to being a visual factor, this also increases safety.

FIG. 3 presents a simplified and diagrammatic view of a partially sectioned door arrangement, according to FIG. 1, of a landing door of an elevator as seen from the direction of the elevator car 1. For the sake of clarity a part of the side wall of the suspension beam 8 on the elevator car 1 side has been cut away at the point of the door panels 4. In this case both the elevator car 1 side support rollers 8*a* of a door panel 4 are clearly visible on top of the travel surface formed by the bottom flange 8*b* of the suspension beam 8. Correspondingly, the top flange 8*c* of the suspension beam 8 forms a blocking surface, which prevents the support rollers 8*a* from jumping out of place. The support rollers 8*a* are fixed by means of their center shafts to the door panels 4 and mounted on bearings to rotate around either their center shafts or their shaft fixings.

The locking apparatus 13 and the rollers 9 of the door coupler, including the door operator, as well as the synchronization means 10 can be e.g. conventional structures. The synchronization means 10 is composed e.g. of two belt wheels 10*a*, each of which is mounted on bearings to a fixed location on the floor level 2, e.g. to a wall element 2*a* that is at the roof boundary of the floor level 2 and above the suspension beam 8, between the door panels 4 of the landing and the wall element 2*a*. The synchronization means 10 with its parts is behind the door panels 4 in FIG. 3, so for the sake of clarity it is drawn with a dot-and-dash line. The belt wheels 10*a* are connected to each other e.g. with a toothed belt 10*b* or corresponding actuator means in such a way that when the toothed belt 10*b* moves, the toothed belt 10*b* rotates both belt wheels 10*a*. The first door panel 4 is fixed to the upper part of the toothed belt 10*b* by the aid of a fixing means 11 and the second door panel 4 is fixed to the lower part of the toothed belt 10*b* by the aid of a fixing means 12 in such a way that when the second door panel 4 of a landing door moved by the door coupler structure 7 of the door operator of the elevator car 1 moves in one direction, the first door panel 4 moves, moved by the toothed belt 10*b*, in the second direction at the same speed as the first door panel 4. In this way the door panels 4 open and close synchronously with each other. Also a V-belt, chain or different ropes can, instead of a toothed belt 10*b*, be used for the synchronization.

FIG. 4 presents a simplified and diagrammatic oblique top view of one sectioned suspension beam 5, 8 of the door panels 3, 4 belonging to a door arrangement according to the invention. In FIG. 4 the suspension beam 5, 8 is truncated and only one of its ends is presented. The suspension beam 5, 8 is composed e.g. of two C-beams fixed face-to-face to each other at their flanges, the bottom flanges 8*b* and top flanges 8*c* of which C-beams are attached to each other at both their ends, but in which flanges 8*b*, 8*c* a gap 16 is cut for the lead-in of the door panels 3, 4. The gap 16 can also be implemented e.g. by situating an intermediate piece forming the gap 16 between the bottom flanges 8*b* and the top flanges 8*c* of the C-beams at both ends of the suspension beam 5, 8 and by fixing the C-beams face-to-face to each other. One such solution is described in more detail in FIG. 5 and in the descriptive part of it.

Since the door panels 3, 4 are disposed centrally in the longitudinal center line of the suspension beams 5, 8, i.e. in the center of the suspension beams 5, 8, the mass of the door is centered with respect to the supporting of it. In this case there is no need to take the centering of the moving masses into account in the manufacturing of the doors. This facilitates both the manufacture and the installation of the doors.

On the top surface of the bottom flange 8*b* of the suspension beam 5, 8 is a travel surface 14 for the support rollers 5*a*, 8*a* of the door panels and on the bottom surface of the top flanges is a blocking surface 15 for preventing the support rollers 5*a*, 8*a* from jumping out of their location, so that separate counterwheels, which prevent a door panel from turning from the center line from the horizontal force effect exerted on the bottom edge of the door panel from the trajectory of the door, are not needed. The C-beams forming a suspension beam 5, 8 are fixed to each other at their ends in some suitable manner to form a firm structure, e.g. with a bolt-nut fastening by means of the fixing holes 17, or with some suitable band fastening, or with some other suitable fixing method, of which one example is presented in FIG. 5.

The travel surfaces 14 of the support rollers 5*a*, 8*a*, said surfaces being in the suspension beam 5, 8, are preferably coated with some suitable noise-damping material, such as with polyurethane, which damps the noise coming from a support roller 5*a*, 8*a* so much that the support rollers 5*a*, 8*a* can be just generally available and inexpensively priced bearings. One alternative is support rollers 5*a* and 8*a* that are essentially large in diameter, which the solution according to the invention enables. Rollers of large diameter can be coated with softer coatings. Soft coatings and a large diameter anyway enable advantages such as improved ride comfort through a quieter and steadier run as well as the longer service life of the support rollers.

FIG. 5 presents a simplified and diagrammatic oblique top view of one fixing solution of the C-beams forming a suspension beam 5, 8 belonging to the door arrangement according to the invention, at one end of the suspension beam 5, 8. In FIG. 5 the suspension beam 5, 8 is truncated in such a way that only one of the ends of the suspension beam 5, 8 is visible.

The two C-beams placed facing each other and forming the suspension beam 5, 8 are fixed to each other at their ends by means of an essentially slab-shaped fixing piece 18, which because of its cross-sectional shape forces a gap 16 to be left between the bottom flanges 8*b* and the top flanges 8*c* of the C-beams, said gap being needed by the door panels 3, 4, and which fixing piece 18 at the same time supports the fixing of the C-beams. The fixing piece 18 according to the embodiment has a first flange part, i.e. a flange part 19, outside the suspension beam 5, 8, and a second flange part, i.e. a flange part 20, inside the suspension beam 5, 8, and a center flange part 21 forming the gap 16 that is between the flange parts 19, 20. The inside and outside flange part 19, 20 are wider in the cross-section of the fixing piece 18 than the center flange part 21 and all the flange parts 19-21 are situated symmetrically in the cross-section of the fixing piece 18 in relation to both the vertical axis and the horizontal axis of the cross-section. In addition, the thickness of the center flange part 21 is essentially at least as large as the thickness of the bottom flanges 8*b* and the top flanges 8*c* of the C-beams. In this case a groove for the bottom and top flanges 8*b*, 8*c* of the C-beams is formed in both side edges of a fixing piece 18. The fixing pieces 18 are fixed to the bottom flanges and top flanges 8*b*, 8*c* of the C-beams e.g. by means of fixing means 22, such as screws or bolts and nuts.

The fixing pieces 18 can also be different in their cross-section to what is presented above. For example, they can be missing either the outside flange part 19 or the inside flange part 20, and the thickness of the center flange part 21 can in this case also be smaller or larger than the thickness of the bottom flanges 8*b* and the top flanges 8*c* of the C-beams. One embodiment in this case is a combined fixing piece 18, which does not have inside flange parts 20 at all and in which the centre flange part 21 extends from the outside flange part 19 of the top flange 8*c* of the C-beam to the outside flange part 19 of the bottom flange 8*b* of the C-beam. One embodiment can also be such that the inside flange part 20 in the preceding solution replaces the outside flange part 19 and the center flange part 21 extends to above and to below the inside flange parts 20 as well as between them. Yet another embodiment can be such that only the aforementioned center flange part 21 is the fixing piece 18, i.e. a straight slab, which extends from the bottom surface of the bottom flanges 8*b* of the C-beams to the top surface of the top flanges 8*c*. In these examples presented above only one solid fixing piece 18 is at each end of a suspension beam 5, 8.

A suspension beam 5 of the door panels 3 of the elevator car 1 is structurally an essentially shallow construction and essentially similar to, as well as essentially the same size at least in its cross-section as, the suspension beams 8 of the door panels 4 of the landing doors of the elevator. The inside height of the cross-sections of the suspension beams 5, 8 is greater only by essentially the amount of the clearance enabled by rotation of the support rollers 5*a*, 8*a* of the door panels 3, 4 than the diameter of the support rollers 5*a*, 8*a*. In this case the support rollers 5*a*, 8*a* fit to rotate well on their travel surface 14, but are not able to jump out of their location. The shallow construction of the suspension beams 5, 8 is also seen in that the outside height of the suspension beams 5, 8, which in terms of their cross-section are rectangular tubes or corresponding structures, is greater only by the amount of the thickness of the bottom flanges 8*b* and the top flanges 8*c* of the suspension beams 5, 8 than the inside height of the cross-sections of the suspension beams 5, 8.

The door arrangement according to the invention is characterized in that the door panels 3 of the elevator car 1 and the door panels 4 of the landing doors are essentially similar to each other. This, in turn, enables modular structures. Other characteristic features are also that the support rollers 5*a* of a door panel 3 of an elevator car 1 are disposed symmetrically with respect to the vertical line of the door panel 3 on both sides of the door panel 3 in such a way that the weight of the door panel 3 of the elevator car 1 is distributed essentially centrally onto the support rollers 5*a* that are on both sides of the door panel 3. Correspondingly, the support rollers 8*a* of a door panel 4 of the landing doors are disposed symmetrically with respect to the vertical line of the door panel 4 on both sides of the door panel 4 in such a way that the weight of the door panel 4 of the landing door is distributed essentially centrally onto the support rollers 8*a* that are on both sides of the door panel 4.

The door arrangement according to the invention is further characterized in that the door panels 3 of the elevator car 1 are arranged to extend from below their suspension beam 5 through their suspension beam 5 to above their suspension beam 5 and, correspondingly, the door panels 4 of the landing doors are arranged to extend from below their suspension beams 8 through their suspension beams 8 to above their suspension beams 8. Likewise, the door arrangement according to the invention is characterized in that the door motor 6 of the elevator car 1 is connected to directly move the door panels 3 of the elevator car 1, and that the door coupler structure 7 is fixed directly to a door panel 3 of the elevator car 1 above the suspension beam 5. Correspondingly, the synchronization means 10 of a landing door of the elevator is connected directly to the door panels 4 of the landing door above the suspension beam 8 and the rollers 9 of the door coupler are fixed directly to one door panel 4 of the landing door above the suspension beam 8.

Suspension beams 5, 8 that are similar to each other and thin door panels 3, 4 in the door of the elevator car 1 and in the landing doors enable a modular structural assembly, making diversified use of the same structural elements easier. The structure of the door panels 3, 4 can be e.g. a sandwich structure, wherein various stainless steels or galvanized sheet metal, or other metal sheets of corresponding thicknesses, such as copper sheets or brass sheets, are used as a surfacing. A filler material, e.g. polyurethane, fireproof wool or corresponding material that allows the use of glue for fixing the materials, is glued between two metal sheets. Lightweight filler material enables extremely lightweight doors and simultaneously, however, dampens noises from the door panels 3 and 4, in which case the doors are extremely quiet. Additionally, the door panels 3, 4 can be surfaced with a separate material desired by the customer provided, however, that the thickness of a door panel 3, 4 remains within the permitted limits.

The different solutions and features presented above can be inventive features together with one or more other features of the invention.

It is obvious to the person skilled in the art that the invention is not limited solely to the examples described above, but that it may be varied within the scope of the claims presented below. Thus, for example, the upper door operator structures of the suspension beams can be different to what is presented above.

It is also obvious to the person skilled in the art that, instead of the center-opening sliding door structure presented, the door arrangement according to the invention also comprises sliding doors of the telescopic type for elevators as well as swing doors for elevators.

It is further obvious to the person skilled in the art that the door arrangement can be implemented in such a way that the door panels extend from below upwards only up to the suspension beam, and do not extend through the suspension beams to above the suspension beams. In this case for the suspension beams there are separate support parts that are supported by a support roller and that function in the manner of support trolleys, on which support parts the door panels are suspended.

The support parts are fixed at their bottom edge to the top edges of the door panels either inside the suspension beams or immediately below the suspension beams. Each suspension part carries e.g. one door panel.

The invention claimed is:

1. A door assembly, comprising:

an elevator car door assembly configured to be coupled to an elevator car, the elevator car door assembly including an elevator car door suspension beam configured to be coupled to an upper portion of the elevator car, a plurality of elevator car door panels, wherein, each given elevator car door panel includes a panel body and at least two sets of support rollers coupled to opposite sides of the panel body of the given elevator car door panel, the support rollers of each given elevator car door panel are configured to engage with the elevator car door suspension beam, such that the given elevator car door panel is suspended from the elevator car door suspension beam by the support rollers of the given elevator car door panel, and each given elevator car door panel is configured to move in a direction that is substantially parallel with a longitudinal axis of the elevator car door suspension beam, based on rolling engagement of the support rollers of the given elevator car door panel with the elevator car door suspension beam along the longitudinal axis of the elevator car door suspension beam, a door drive motor above the elevator car door suspension beam, the door drive motor configured to move the elevator car door panels in relation to the elevator car, and a door coupler structure above the elevator car door suspension beam, the door coupler structure coupled to at least one elevator car door panel such that the door coupler structure is configured to move according to movement of the at least one elevator car door panel; and at least one elevator landing door assembly configured to be coupled to an upper portion of a floor level landing, the at least one elevator landing door assembly including an elevator landing door suspension beam configured to be coupled to the upper portion of the floor level landing, a plurality of elevator landing door panels, wherein, each given elevator landing door panel includes a panel body and at least two sets of support rollers coupled to opposite sides of the panel body of the given elevator landing door panel, the support rollers of each given elevator landing door panel are configured to engage with the elevator landing door suspension beam, such that the given elevator landing door panel is suspended from the elevator landing door suspension beam by the support rollers of the given elevator landing door panel, and each given elevator landing door panel is configured to move in a direction that is substantially parallel with a longitudinal axis of the elevator landing door suspension beam, based on rolling engagement of the support rollers of the given elevator landing door panel with the elevator landing door suspension beam along the longitudinal axis of the elevator landing door suspension beam, a plurality of rollers coupled to at least one elevator landing door panel above the elevator landing door suspension beam, the rollers configured to engage with the door coupler structure of the elevator car door assembly to such that the at least one elevator landing door panel is configured to move according to movement of the at least one elevator car door panel, and a synchronization device configured to move the elevator landing door panels synchronously based on movement of the at least one elevator landing door panel, wherein each of the elevator car door suspension beam and the elevator landing door suspension beam is a substantially rectangular tube structure, each given substantially rectangular tube structure including, an interior space with a substantially rectangular cross section, and top and bottom flanges, wherein a difference between an external height of the given substantially rectangular tube structure and an interior height of the interior space of the given substantially rectangular tube structure corresponds with a combined thickness of the top and bottom flanges, wherein the elevator car door panels are configured to extend vertically through the interior space of the given substantially rectangular tube structure of the elevator car door suspension beam.

2. The door assembly according to claim 1, wherein, the elevator car door suspension beam and the elevator landing door suspension beam have a substantially common size and cross-section, and the elevator car door suspension beam has a shallow construction.

3. The door assembly according to claim 1, wherein, a cross-section of each of the elevator car door suspension beam and the elevator landing door suspension beam includes the interior space, the support rollers of the plurality of elevator car door panels are configured to be located within the interior space of the elevator car door suspension beam, such that the support rollers of the plurality of elevator car door panels are configured to rollably engage with the elevator car door suspension beam within the interior space of the elevator car door suspension beam, the interior space of the elevator car door suspension beam is greater than an individual diameter of each of the support rollers of the elevator car door panels according to an amount of clearance enabled by rotation of the support rollers of the elevator car door panels;

the support rollers of the plurality of elevator landing door panels are configured to be located within the interior space of the elevator landing door suspension beam, such that the support rollers of the plurality of elevator landing door panels are configured to rollably engage with the elevator landing door suspension beam within the interior space of the elevator landing door suspension beam; and the interior space of the elevator landing door suspension beam is greater than an individual diameter of each of the support rollers of the elevator landing door panels according to an amount of clearance enabled by rotation of the support rollers of the elevator landing door panels.

4. The door assembly according to claim 1, wherein, the support rollers of each given elevator car door panel are configured to distribute a supported weight of the given elevator car door panel substantially evenly between the at least two sets of support rollers coupled to opposite sides of the panel body of the given elevator car door panel.

5. The door assembly according to claim 1, wherein, the support rollers of each given elevator landing door panel are configured to distribute a supported weight of the given elevator landing door panel substantially evenly between the at least two sets of support rollers coupled to opposite sides of the panel body of the given elevator landing door panel.

6. The door assembly according to claim 1, wherein the elevator car door panels and the elevator landing door panels have substantially common dimensions.

7. The door assembly according to claim 1, wherein the elevator landing door panels are configured to extend vertically through the interior space of the elevator landing door suspension beam.

8. The door assembly according to claim 1, wherein, the door drive motor is configured to directly move the elevator car door panels, and the door coupler structure is fixed to the at least one elevator car door panel.

9. The door assembly according to claim 1, wherein, the synchronization device is coupled directly to the elevator landing door panels, and the plurality of rollers are fixed to one of the elevator landing door panels.

10. The door assembly according to claim 1, wherein the elevator car door suspension beam is configured to be directly coupled to a top edge of a door opening of the elevator car.

11. The door assembly according to claim 1, wherein the elevator landing door suspension beam is configured to be directly coupled to a top edge of a door opening of the floor level landing.

12. An elevator door assembly, comprising:

an elevator door suspension beam configured to be coupled to an upper portion of an elevator car or an upper portion of a floor level landing; and at least one elevator door panel including a panel body and at least two sets of support rollers coupled to opposite sides of the panel body, the support rollers configured to engage with the elevator door suspension beam at a substantially common height in relation to a longitudinal axis of the elevator door suspension beam, such that, the at least one elevator door panel is suspended from the elevator door suspension beam by the support rollers, and the at least one elevator door panel is configured to move in a direction that is substantially parallel with the longitudinal axis of the elevator door suspension beam, based on rolling engagement of the support rollers of the at least one elevator door panel with the elevator door suspension beam along the longitudinal axis of the elevator door suspension beam, wherein the elevator door suspension beam is a substantially rectangular tube structure, the substantially rectangular tube structure including, an interior space with a substantially rectangular cross section, and top and bottom flanges, wherein a difference between an external height of the substantially rectangular tube structure and an interior height of the interior space of the substantially rectangular tube structure corresponds with a combined thickness of the top and bottom flanges, wherein the at least one elevator door panel is configured to extend vertically through the interior space of the substantially rectangular tube structure of the elevator door suspension beam.

13. The elevator door assembly of claim 12, wherein, the support rollers of the at least one elevator door panel are configured to be located within the interior space of the substantially rectangular tube structure of the elevator door suspension beam, such that the support rollers are configured to rollably engage with the elevator door suspension beam within the interior space of the elevator door suspension beam; and the interior space of the elevator door suspension beam is greater than an individual diameter of each of the support rollers of the at least one elevator door panel according to an amount of clearance enabled by rotation of the support rollers of the at least one elevator door panel.

14. The elevator door assembly of claim 12, wherein, the support rollers of the at least one elevator door panel are configured to distribute a supported weight of the at least one elevator door panel substantially evenly between the at least two sets of support rollers coupled to opposite sides of the panel body of the at least one elevator door panel.

15. The elevator door assembly of claim 12, wherein, the elevator door assembly is an elevator car door assembly configured to be coupled to the elevator car, such that the elevator door assembly further includes, a door drive motor above the elevator door suspension beam, the door drive motor configured to move the at least one elevator door panel in relation to the elevator car, and a door coupler structure above the elevator door suspension beam, the door coupler structure coupled to the at least one elevator door panel such that the door coupler structure is configured to move according to movement of the at least one elevator door panel.

16. The elevator door assembly of claim 12, wherein, the elevator door assembly is an elevator landing door assembly configured to be coupled to the floor level landing, such that the elevator door assembly further includes, a plurality of elevator door panels, a plurality of rollers coupled to at least one elevator door panel above the elevator door suspension beam, the rollers configured to engage with a door coupler structure of the elevator door assembly to such that the at least one elevator door panel is configured to move according to movement of the engaged door coupler structure, and a synchronization device configured to move the plurality of elevator door panels synchronously based on movement of the at least one elevator door panel.

* * * * *